US007238924B2

(12) United States Patent
Kondo et al.

(10) Patent No.: US 7,238,924 B2
(45) Date of Patent: Jul. 3, 2007

(54) MAGNETIC FLUX IMAGE HEATING APPARATUS WITH CONTROL OF MOVEMENT OF MAGNETIC FLUX SHIELD

(75) Inventors: Toshiharu Kondo, Moriya (JP); Yasuhiro Yoshimura, Ryugasaki (JP); Yasuo Nami, Toride (JP); Naoyuki Yamamoto, Toride (JP); Takahiro Nakase, Toride (JP); Hitoshi Suzuki, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/254,705

(22) Filed: Oct. 21, 2005

(65) Prior Publication Data

US 2006/0086730 A1 Apr. 27, 2006

(30) Foreign Application Priority Data

Oct. 22, 2004 (JP) ..... 2004-307529

(51) Int. Cl.
*H05B 6/14* (2006.01)
*G03G 15/20* (2006.01)

(52) U.S. Cl. ..... 219/619; 219/667; 219/665; 399/328; 399/330

(58) Field of Classification Search ..... 219/619, 219/652, 667, 665; 399/328–338
See application file for complete search history.

(56) References Cited

U.S. PATENT DOCUMENTS

| | | | | |
|---|---|---|---|---|
| 5,464,964 | A | 11/1995 | Okuda et al. | 219/497 |
| 5,747,774 | A | 5/1998 | Suzuki et al. | 219/216 |
| 6,373,036 | B2 | 4/2002 | Suzuki | 219/619 |
| 6,492,630 | B2 | 12/2002 | Nagahira | |
| 6,713,734 | B2 | 3/2004 | Suzuki | 219/619 |
| 6,782,216 | B2 | 8/2004 | Suzuki | 399/69 |
| 6,969,833 | B2 | 11/2005 | Suzuki | 219/619 |
| 6,970,664 | B2 | 11/2005 | Yamamoto | 399/69 |
| 7,034,261 | B2 | 4/2006 | Suzuki | 219/619 |
| 7,038,178 | B2 | 5/2006 | Suzuki | 219/619 |
| 7,122,769 | B2 | 10/2006 | Nami et al. | 219/619 |
| 7,132,631 | B2 | 11/2006 | Nami et al. | 219/619 |
| 2002/0148828 | A1 | 10/2002 | Nagahira | |
| 2003/0077093 | A1 | 4/2003 | Sekiguchi | |
| 2005/0006378 | A1* | 1/2005 | Suzuki | 219/619 |
| 2005/0173415 | A1 | 8/2005 | Yamamoto et al. | 219/619 |
| 2005/0252912 | A1 | 11/2005 | Yamamoto | 219/619 |

(Continued)

FOREIGN PATENT DOCUMENTS

JP 2002-287563 10/2002

(Continued)

*Primary Examiner*—Philip H. Leung
(74) *Attorney, Agent, or Firm*—Fitzpatrick, Cella, Harper & Scinto

(57) ABSTRACT

An image heating apparatus includes a heating rotatable member for heating an image on a recording material in a heating nip; a magnetic flux generator for generating a magnetic flux for induction heat generation in the heating rotatable member; a magnetic flux confining device for confining the magnetic flux directed toward a predetermined region of the heating rotatable member from the magnetic flux generator; and a moving device for repeatedly moving the magnetic flux confining device during a heating operation between the operating position and a retracted position retracted from the operation position, when the recording material which has a predetermined width overlapping with a part of the predetermined region is continuously heated by the apparatus.

6 Claims, 9 Drawing Sheets

U.S. PATENT DOCUMENTS

| | | | | |
|---|---|---|---|---|
| 2006/0086719 | A1 | 4/2006 | Suzuki et al. | 219/619 |
| 2006/0086720 | A1 | 4/2006 | Nakase et al. | 219/619 |
| 2006/0086724 | A1 | 4/2006 | Yamamoto et al. | 219/619 |
| 2006/0086726 | A1 | 4/2006 | Yamamoto et al. | 219/619 |
| 2006/0086730 | A1 | 4/2006 | Kondo et al. | 219/645 |
| 2006/0088328 | A1 | 4/2006 | Yoshimura et al. | 399/69 |
| 2006/0088329 | A1 | 4/2006 | Suzuki et al. | 399/69 |

FOREIGN PATENT DOCUMENTS

| | | |
|---|---|---|
| JP | 2002-323829 | 11/2002 |
| JP | 2003-123957 | 4/2003 |
| JP | 2004-170622 | 6/2004 |
| JP | 2004-265670 | 9/2004 |

* cited by examiner

MAGNETIC FLUX IMAGE HEATING APPARATUS WITH CONTROL OF MOVEMENT OF MAGNETIC FLUX SHIELD

FIELD OF THE INVENTION AND RELATED ART

The present invention relates to an image heating apparatus for heating an image on recording medium. As an example of such an image heating apparatus, a fixing apparatus for fixing an unfixed image formed on recording medium, an apparatus for increasing in glossiness a fixed image on recording medium, by heating the image, etc., can be listed.

An electrophotographic copying machine, or the like, in accordance with the prior art is provided with a heating apparatus, which is for heating an unfixed image (image formed of toner) on recording medium (unfixed image having been transferred onto recording medium while recording medium is conveyed) so that the toner (developer) of which the unfixed image is formed is fused to recording medium by being thermally melted.

As for the type of such a heating apparatus, there have been known: a heating apparatus, the fixation roller, as a heating medium, of which has been reduced in wall thickness and diameter for faster temperature increase; a heating apparatus comprising a rotatable resin film, and a heating member placed in contact with the rotatable film from inside the loop of the rotatable film with the application of a predetermined amount of pressure; a heating apparatus comprising a rotatable metallic member with a thin wall, which can be heat by electromagnetic induction; etc. These heating apparatuses are characterized in that each of them is designed to minimize its rotatable member as a heating medium in thermal capacity and to heat the rotatable member with the use of a heat source higher in thermal efficiency. There are also heating apparatuses employing a heat source of the noncontact type. However, in the field of an image forming apparatus such as a copying machine, a heating apparatus of the type which thermally melts the developer on recording medium by placing a rotatable member with a thin wall, with the recording medium, has been proposed by a greater number than a heating apparatus employing a heat source of the noncontact type, from the standpoint of cost and energy efficiency.

However, if a rotatable member as a heating medium is reduced in wall thickness to reduce it in thermal capacity, it is also reduced in the size of the sectional area perpendicular to its axial line, being thereby reduced in the thermal transfer rate, in terms of the axial direction of the rotatable member, and the thinner the wall of a rotatable member, the more conspicuous this reduction in thermal transfer rate. Further, in the case of a rotatable member formed of resin or the like which is lower in coefficient of thermal conductivity, this characteristic is even more conspicuous.

When the coefficient of thermal conductivity of an object is $\lambda$; the difference in temperature between the two points of the object is ($\theta 1-\theta 2$); and the distance between the two points is L, the amount Q by which heat is transferred per unit of time between two points of the object is expressed by the following equation, which is obvious from Fourier s law:

$$Q=\lambda \grave{u} f(\theta 1-\theta 2)/L.$$

The above described characteristic does not causes any problem when an image to be fixed is borne on a recording medium of the largest size usable with a heating apparatus, that is, the recording medium on which the image to be fixed is borne is a widest recording medium, in terms of the lengthwise direction of the rotatable member, usable with the heating apparatus. However, when multiple recording mediums smaller in width in terms of the lengthwise direction of the rotatable member than the largest recording medium are used, the following problem occurs. That is, the temperature of the rotatable member increases above the target temperature (proper temperature for fixation) across the portions outside the path of the recording medium with the smaller width, in terms of the lengthwise direction of the rotatable member. As a result, the difference in temperature between the portion of the rotatable member within the path of the recording mediums of the smaller width and the portions of the rotatable member outside the path of the recording mediums with the smaller width becomes extremely large.

Since the components in the adjacencies of the heating medium are usually formed of resinous materials, there is a possibility that their service lives will be reduced in terms of heat resistance, and/or they will be thermally damaged, by this nonuniformity in the temperature of the heating medium in terms of its lengthwise direction. Moreover, there is the problem that as a recording medium of the larger size is conveyed through a heating apparatus immediately after multiple recording mediums of the smaller size are continuously conveyed through the heating apparatus, it is possible that the recording medium of the large size will be wrinkled and/or skewed, and/or the image on the recording medium will be nonuniformly fixed, by the nonuniformity in temperature across the parts of the heating medium. The difference in temperature between the portion of the heating medium within the path of a recording medium and the portion(s) of the heating medium outside the path of a recording medium is roughly proportional to the thermal capacity of a recording medium to be conveyed through a heating apparatus, and also, to the throughput (number of prints outputted per unit of time) of each job. Therefore, a heating apparatus, the heating medium of which is a rotatable member with a thin wall and is low in thermal capacity, has been difficult to satisfactorily use as the fixing apparatus for a copying machine or the like which is high in throughput.

As a means for solving the above described problem, there has been known a heating apparatus employing multiple halogen lamps or heat generating resistors, as heat sources, so that the portions of the heating medium can be selectively supplied with electric power according to the width of a recording medium to be conveyed through the heating apparatus.

Admittedly, there have been heating apparatuses which employ multiple heat sources comprising an induction coil so that the heat sources can be selectively supplied with electric power to solve the above described problem. However, providing a heating apparatus with multiple heat sources or dividing the heat source of a heating apparatus into multiple sections makes the control circuit of the heating apparatus more complicated and higher in cost. Moreover, the attempt to match the number of heat sources to the number of the types of the recording mediums (media) usable with a heating apparatus (image forming apparatus) and different in width, requires the heating apparatus to be further increased in the number of the heat sources, or the number of the sections into which the heat source of a heating apparatus is to be subdivided, further increasing the heating apparatus in cost. In addition, there is another problem in the case of a heating apparatus, the heating medium of which is a rotatable member with a thin wall.

That is, the heat source becomes discontinuous and nonuniform in temperature distribution, across the joints between the subsections of the heat source, which will possibly affect the performance of a heating apparatus in terms of image fixation.

Thus, it has been proposed to provide a heating apparatus based on electromagnetic induction with a magnetic flux blocking means for partially blocking the magnetic flux directed toward the heating medium from the means for electromagnetically heating the heating medium, and a means for changing in position the magnetic flux blocking means (for example, Japanese Laid-open Patent Application 2004-265670). According to this proposal (invention), the portions of the magnetic flux, which are directed toward the portions of the heating medium, which do not need to be heated, are blocked by moving the magnetic flux blocking means. Therefore, heat is not generated in the portions of the heating medium, which do not need to be heated; in other words, the heating medium is controlled in terms of where in the heating medium heat is to be generated, being therefore controlled in terms of the heat distribution thereof. The heating apparatus (fixing apparatus) disclosed in Japanese Laid-open Patent Application 2004-265670 is structured so that its magnetic flux blocking plate can be rotated in the hollow of its fixation roller, having therefore the merit of being smaller in the dimension in terms of the lengthwise direction of the apparatus, compared to a heating apparatus (fixing apparatus) structured so that its magnetic flux blocking plate is moved in the direction parallel to the lengthwise direction its heat roller, for example.

According to Patent Document 1, the temperature increase, which occurs across the portions of the heating medium outside the path of a recording medium of a medium or small size, that is, the size smaller than the size of the largest recording medium conveyable through the heating apparatus (image forming apparatus), is dealt with by employing a magnetic flux blocking plate, the magnetic flux blocking portions of which are matched in size with the recording medium of the medium or small size. However, the market offers too many kinds of recording mediums in terms of size, making it difficult to deal with the above described problem by adjusting the magnetic flux according to each of the various recording medium sizes. It is possible to give the actual adjusting portion of a magnetic flux adjusting means a stepless shape. However, enabling the magnetic flux adjusting portions to adjust the magnetic flux according to all of the various recording medium sizes makes it necessary to reduce each of the magnetic flux adjusting portions of the magnetic flux adjusting member, which correspond one for one to the various recording medium sizes, in the dimension in terms of the circumferential direction of the rotatable heating medium, which creates the following problem. That is, even if the magnetic flux adjusting member is moved into the exact position to deal with multiple recording mediums of a given size in order to partially block the magnetic flux, the magnetic flux adjusting portions are too narrow, in terms of the circumferential direction of the rotatable heating medium, to fully shield the portions of the heating medium outside the path of the recording medium of the given size, from the magnetic flux. Therefore, eddy current is induced in the portions of the heating medium outside the coverage by the magnetic flux adjusting portions, in terms of the circumferential direction of the heating medium, and generates heat in the portions of the heating medium. Consequently, the portions of the rotatable heating medium outside the recording medium path are excessively increased in temperature by the heat generated therein.

On the other hand, if a magnetic flux adjusting member designed to accommodate a few of the representative sizes among various recording medium sizes is employed to prevent the temperature increase outside the recording medium path, the portions of the heating medium outside the recording medium path increases in temperature, and/or the heating medium becomes nonuniform across the portion to be used for heating the recording medium being conveyed, when the actual magnetic flux adjusting portions of the magnetic flux adjusting member do not match in size the recording medium being conveyed. More specifically, with the employment of the above described magnetic flux adjusting member, as the magnetic flux adjusting member is moved into the magnetic flux adjusting position when none of the actual magnetic flux adjusting portions of the magnetic flux adjusting member perfectly matches the size of the recording medium used currently for image formation, the magnetic flux adjusting member overlaps with the edge portions of a recording medium being conveyed. Thus, the portions of the heating medium, which correspond in position to the areas in which the magnetic flux adjusting member is overlapping with the recording medium, is robbed of heat each time a recording medium is conveyed through the heating apparatus, even though no heat is generated therein. As a result, these portions of the heating medium fall in temperature. It is possible to reposition the magnetic flux adjusting member so that the actual magnetic flux adjusting portions of the magnetic flux adjusting member, which is one size (step) smaller in terms of the amount by which the magnetic flux is adjusted, than the portions which overlap with the recording medium, blocks the magnetic flux, the excessive temperature increase occurs across the portions of the heating medium outside the recording medium path.

It is also possible to extend the recording medium conveyance interval between a transfer medium and the immediately following transfer medium, according to the size of the following transfer medium, in order to wait until the heating medium becomes normal in temperature level and temperature distribution. However, the employment of this method makes an image forming apparatus very inconvenient to use; for example, it makes the cumulative intervals substantially long when a set of originals are different in size.

SUMMARY OF THE INVENTION

Thus, the primary object of the present invention is to prevent, or reduce in extent, the temperature increase which occurs across the portions of a heating medium outside the recording medium path, even when none of the magnetic flux adjusting portions of the magnetic flux adjusting member match in size the recording medium being conveyed through a heating apparatus.

Another object of the present invention is to provide a magnetic flux adjusting means capable of reducing the nonuniformity in the temperature of a heating medium, which is caused by the continuous conveyance of multiple recording mediums different in size, even when none of the magnetic flux adjusting portions of a magnetic flux adjusting member match in size the recording medium being conveyed through a heating apparatus.

One of the typical image heating apparatuses structured in accordance with the present invention for accomplishing the above described object is characterized in that it comprises: a rotatable heating member for heating an image on recording medium, in the heating nip; a magnetic flux generating means for generating a magnetic flux for heating the rotatable heating member by electromagnetic induction; and a magnetic flux controlling means movable into the magnetic flux controlling position in order to control the magnetic flux directed toward the rotatable heating member from the magnetic flux generating means, and that when multiple recording mediums, the width of which is such that the recording mediums partially overlap with the magnetic flux controlling portions of the magnetic flux controlling means, are continuously conveyed through the image heating apparatus, the magnetic flux controlling means is alternately moved into the magnetic flux controlling position and the retreat position, that is, the position in which the magnetic flux controlling means does not control the magnetic flux, during the heating of the heating member (during image heating operation).

Another of the typical image heating apparatuses in accordance with the present invention for accomplishing the above described objects is characterized in that it comprises: a rotatable heating member for heating an image on recording medium, in the heating nip; a magnetic flux generating means for generating a magnetic flux for heating the rotatable heating member by electromagnetic induction; and a magnetic flux controlling means for controlling the magnetic flux directed toward the rotatable heating member from the magnetic flux generating means, and that the magnetic flux controlling means is provided with a first magnetic flux controlling portions for controlling, in the first controlling position, the magnetic flux directed toward the first portions of the rotatable heating member, and a second magnetic flux controlling portions for controlling, in the second position, the magnetic flux direction toward the second portions of the rotatable heating member, which include the first portions of the rotatable heating member and are greater in dimension in terms of the lengthwise direction of the heating member, and when multiple recording mediums, the width of which is such that the recording mediums partially overlap with the portion of each of the second controlling portions, which is outside the first controlling portion, are continuously conveyed through the image heating apparatus, the magnetic flux controlling means is alternately moved into the first magnetic flux controlling position and the second magnetic controlling position, during the heating of the heating member (during image heating operation).

According to an aspect of the present invention, there is provided an image heating apparatus comprising a heating rotatable member for heating an image on a recording material in a heating nip; magnetic flux generating means for generating a magnetic flux for induction heat generation in said heating rotatable member; magnetic flux confining means for confining the magnetic flux directed toward a predetermined region of said heating rotatable member from said magnetic flux generating means; and moving means for repeatedly moving said magnetic flux confining means during a heating operation between the operating position and a retracted position retracted from the operation position, when the recording material which has a predetermined width overlapping with a part of the predetermined region is continuously heated by said apparatus.

According to another aspect of the present invention, there is provided an image heating apparatus comprising a heating rotatable member for heating an image on a recording material in a heating nip; magnetic flux generating means for generating a magnetic flux for induction heat generation in said heating rotatable member; magnetic flux confining means for confining the magnetic flux directed toward said heating rotatable member from said magnetic flux generating means, wherein said magnetic flux confining means has a first magnetic flux confining portion for confining, at a first position, the magnetic flux toward a first region of said heating rotatable member, and a second magnetic flux confining portion for confining, at a second position, the magnetic flux toward a second region having a width larger than the first region of said heating rotatable member and including the first region; and moving means for moving said magnetic flux confining means at least between said first position and said second position during a heating operation when the recording material having a predetermined width overlapping partly with a region which is in said second region and outside said first region, is repeatedly heated by said apparatus.

According to a further aspect of the present invention, there is provided an image heating apparatus comprising a heating rotatable member for heating an image on a recording material in a heating nip; magnetic flux generating means for generating a magnetic flux for induction heat generation in said heating rotatable member; magnetic flux confining means for confining the magnetic flux directed toward said heating rotatable member from said magnetic flux generating means, wherein said magnetic flux confining means has a first magnetic flux confining portion for confining, at a first position, the magnetic flux toward a first region of said heating rotatable member, and a second magnetic flux confining portion for confining, at a second position, the magnetic flux toward a second region having a width larger than the first region of said heating rotatable member and including the first region; and moving means for moving stepwisely said magnetic flux confining means to said first position and then to said second position when the recording material having a size not overlapping with said second region is continuously heated.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Example of Image Forming Apparatus

Figure 1:
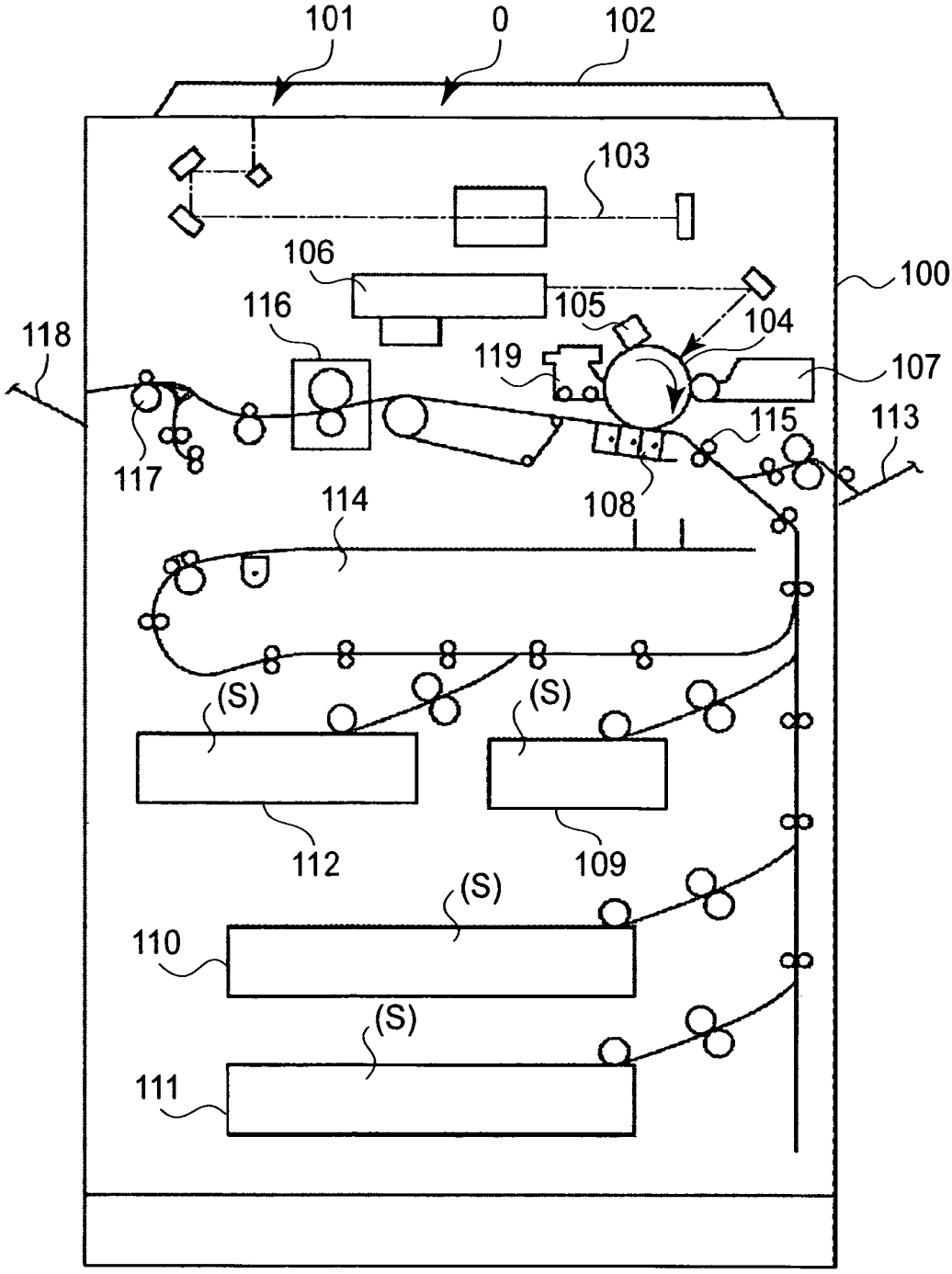
FIG. 1 is a schematic drawing of an image forming apparatus in the first embodiment of the present invention, showing the general structure thereof.

FIG. 1 is a schematic drawing of an image forming apparatus 100 in this embodiment, showing the general structure thereof. The image forming apparatus 100 in this embodiment is a laser copying machine employing one of the electrophotographic processes of the transfer type. Designated by a referential symbol 101 is an original placement glass platen, on which an original O is placed so that it aligns with a predetermined referential marker (line, rib, projection, or the like) for accurately positioning the original and also, so that the image bearing surface of the original O faces downward. Then, an original pressing plate 102 is placed across the platen 101, covering thereby the original O. As a copy start key is pressed, a photoelectric image reading apparatus 103 (reading portion) inclusive of a mobile optical system is activated to photoelectrically process the downwardly facing image bearing surface of the original O on the original placement platen 101; the information (data necessary for copying original) of the image bearing surface, inclusive of the image thereon, is photoelectrically collected. It is possible to provide the image forming apparatus 100 with an automatic original feeding apparatus (ADF, RDF), which is placed on the original placement glass platen 101, in order to automatically feed the original O.

Designated by a referential symbol 104 is an electrophotographic photosensitive member (which hereinafter will be referred to as photosensitive drum), which is in the form of a rotatable drum and is rotationally driven at a predetermined peripheral velocity in the clockwise direction indicated by an arrow mark. While the photosensitive drum 104 is rotated, its peripheral surface is uniformly charged by a charging apparatus 105 to predetermined polarity and potential level. Then, the uniformly charged peripheral surface of the photosensitive drum 104 is exposed to an image writing beam of light L projected by an image writing apparatus 106. As a result, the numerous points of the uniformly charged peripheral surface of the photosensitive drum 104, which have been exposed to the beam of light L, attenuate in potential level, creating thereby an electrostatic latent image which reflects the pattern in which the peripheral surface of the photosensitive drum 104 have been exposed. The image writing apparatus 106 in this embodiment is a laser scanner. In response to a command from an unshown controller, the image writing apparatus 106 outputs a beam of laser light L while modulating it with sequential digital electrical video signals reflecting the information of the original photoelectrically read by the above-mentioned photoelectric reading apparatus 103. To this beam of laser light L which is being oscillated in the direction perpendicular to the rotational direction of the photosensitive drum 104, the uniformly charged portion of the peripheral surface of the rotating photosensitive drum 104 is exposed. As a result, an electrostatic latent image reflecting the information (image formation data) of the original is created on the uniformly charged portion of the peripheral surface of the photosensitive drum 104.

Then, the electrostatic latent image is developed by a developing apparatus 107 into a visible image formed of toner (which hereinafter will be referred to as toner image). The toner image is electrostatically transferred by a transferring apparatus 108 (charging apparatus) from the peripheral surface of the photosensitive drum 104 onto a recording medium S delivered from a recording medium feeding/conveying mechanism, with a predetermined timing, to the transfer portion, which is where the photosensitive drum 104 opposes the transferring apparatus 108.

The recording medium feeding/conveying mechanism of the image forming apparatus in this embodiment comprises first to fourth recording medium feeding portions which accommodate first to fourth recording medium cassettes 109–112, an MP tray 113 (multi-pass tray), a recording medium reversing- and refeeding portion 114, from the selected one of which recording mediums S are conveyed to the transfer portion. Designated by a referential symbol 115 is a pair of registration rollers, which release each recording medium S with a predetermined timing toward the transfer portion.

In the transfer portion, the toner image on the peripheral surface of the photosensitive drum 104 is transferred onto the recording medium S. Then, the recording medium S is separated from the peripheral surface of the photosensitive drum 104, and is conveyed to a fixing apparatus 116, in which the unfixed image on the recording medium S is fixed. Then, the recording medium S is discharged by a pair of sheet discharge rollers 117 onto a delivery tray 118 located outside the main assembly of the image forming apparatus.

Meanwhile, the peripheral surface of the photosensitive drum 104 from which the recording medium S has just been separated is cleaned. That is, the contaminants such as the toner remaining on the peripheral surface of the photosensitive drum 104 after the toner image transfer are removed by a cleaning apparatus 119 to repeatedly use the surface for image formation.

When the image forming apparatus is in the two-sided copy mode, a recording medium S is conveyed in the following manner. That is, after the formation of an unfixed toner image on one (first) of the two surfaces of a recording medium S, the recording medium S is fed into the fixing apparatus 116. As soon as a recording medium is conveyed out of the fixing apparatus 116, it is introduced into the recording medium reversing- and refeeding portion 114, by which it is turned over and refed into the main assembly of the image forming apparatus so that another toner image can be transferred onto the other (second) surface of the recording medium S. After the transfer of the toner image onto the second surface of the recording medium, the recording medium S is conveyed for a second time through the fixing apparatus 116, and is discharged as a two-sided copy by the pair of sheet discharge rollers 117 onto the delivery tray 118 located outside the main assembly of the image forming apparatus.

Incidentally, the copying machine in this embodiment is a multifunction copying machine, which is provided with printing and facsimileing functions in addition to the copying function. However, the additional functions of the machine are not essential to the description of the present invention, and therefore, will not be described.

(2) Example of Fixing Apparatus

Figure 2:
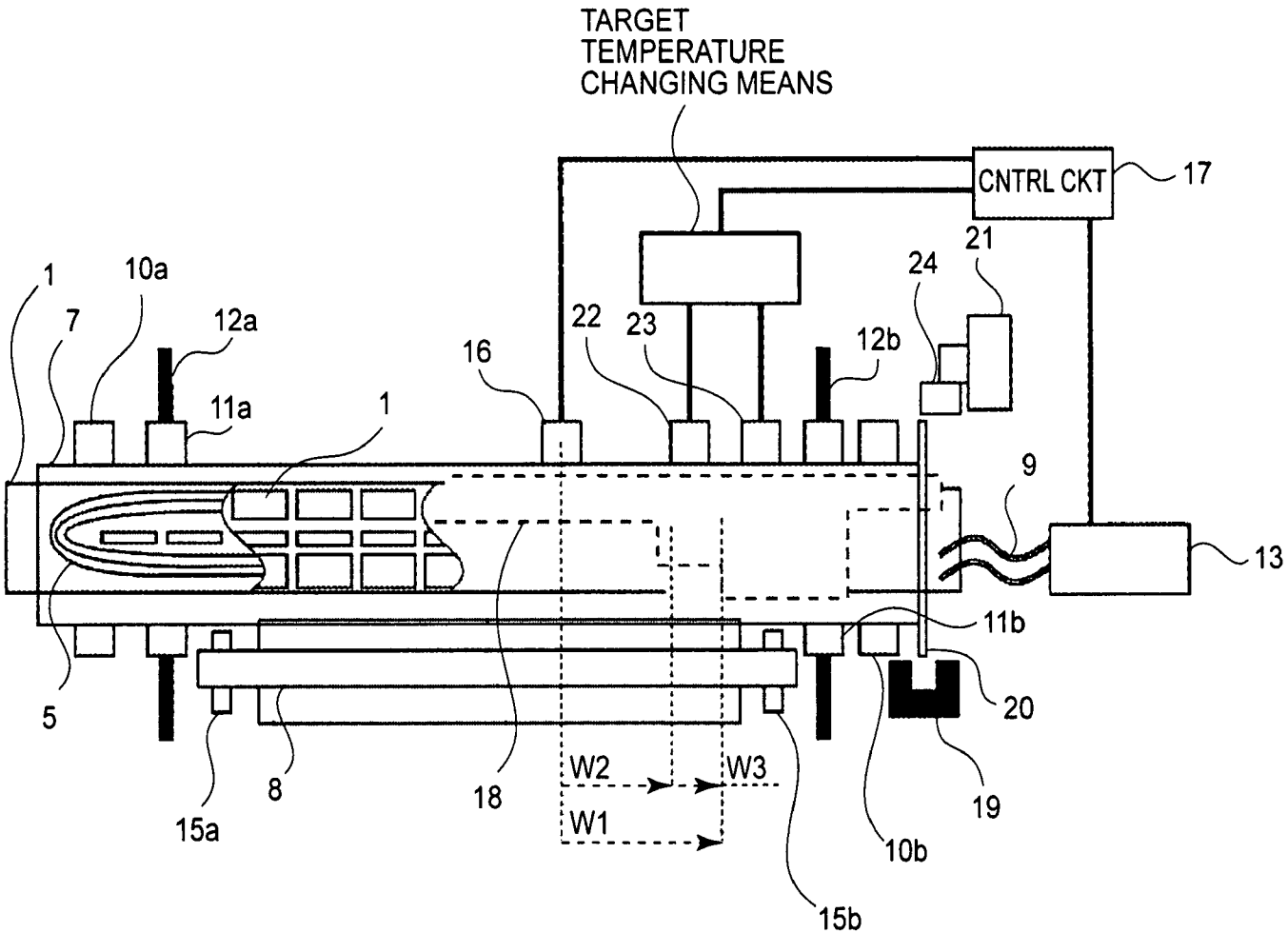
FIG. 2 is a vertical sectional (partially cutaway) view of the heating apparatus in the first embodiment of the present invention.
Figure 3:
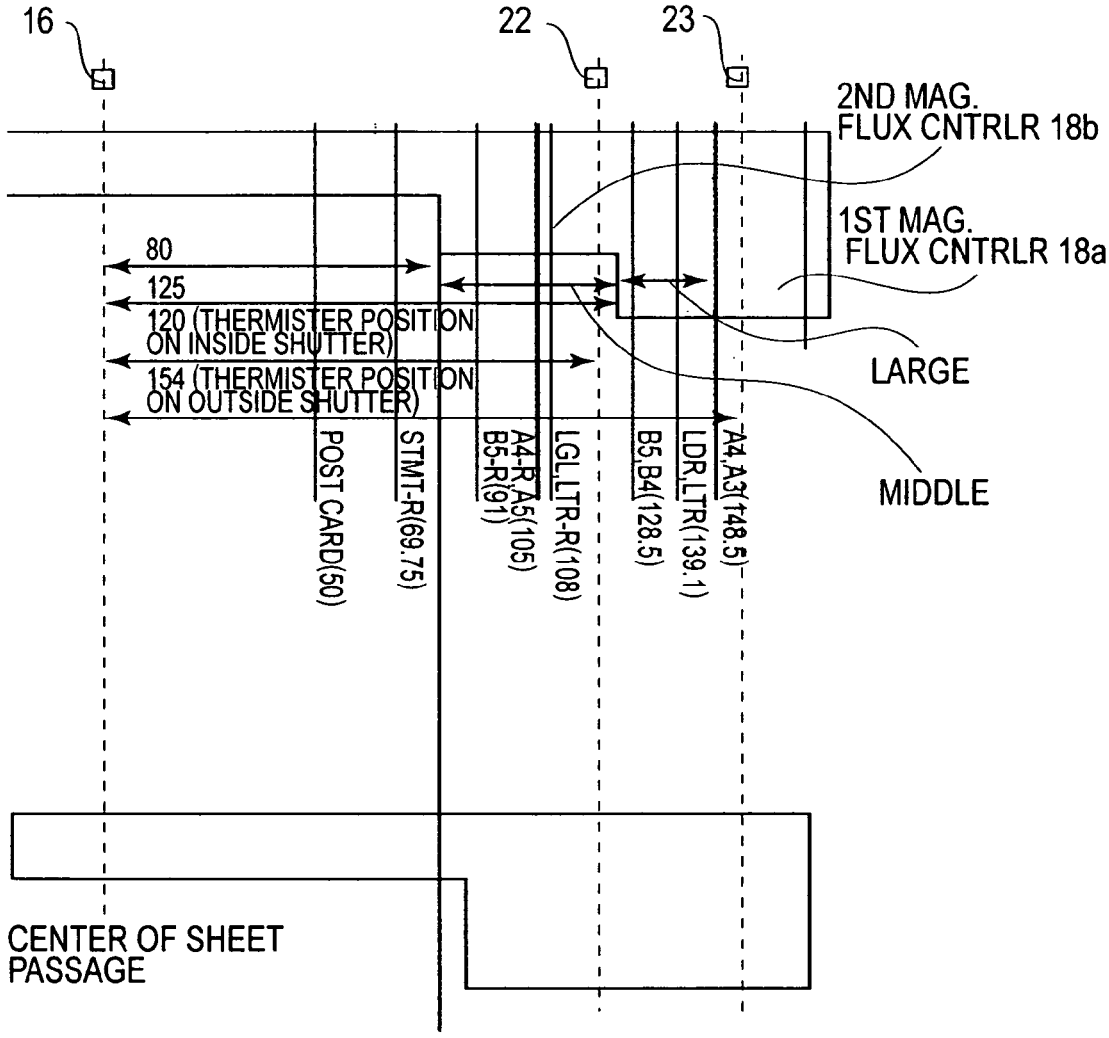
FIG. 3 is a vertical sectional view of the heating apparatus in the first embodiment of the present invention.
Figure 4:
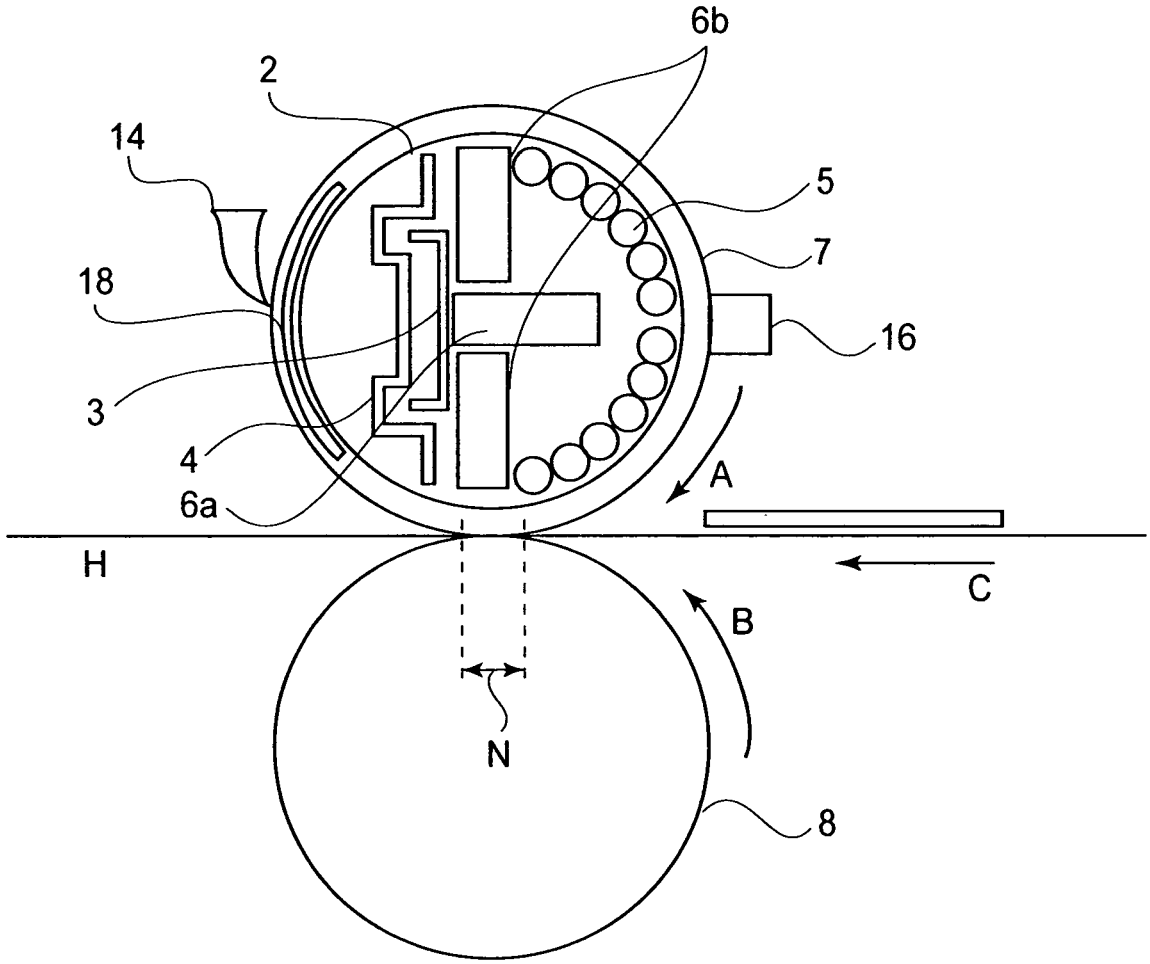
FIG. 4 is a schematic cross-sectional view of the image heating apparatus in accordance with the present invention.
Figure 5:
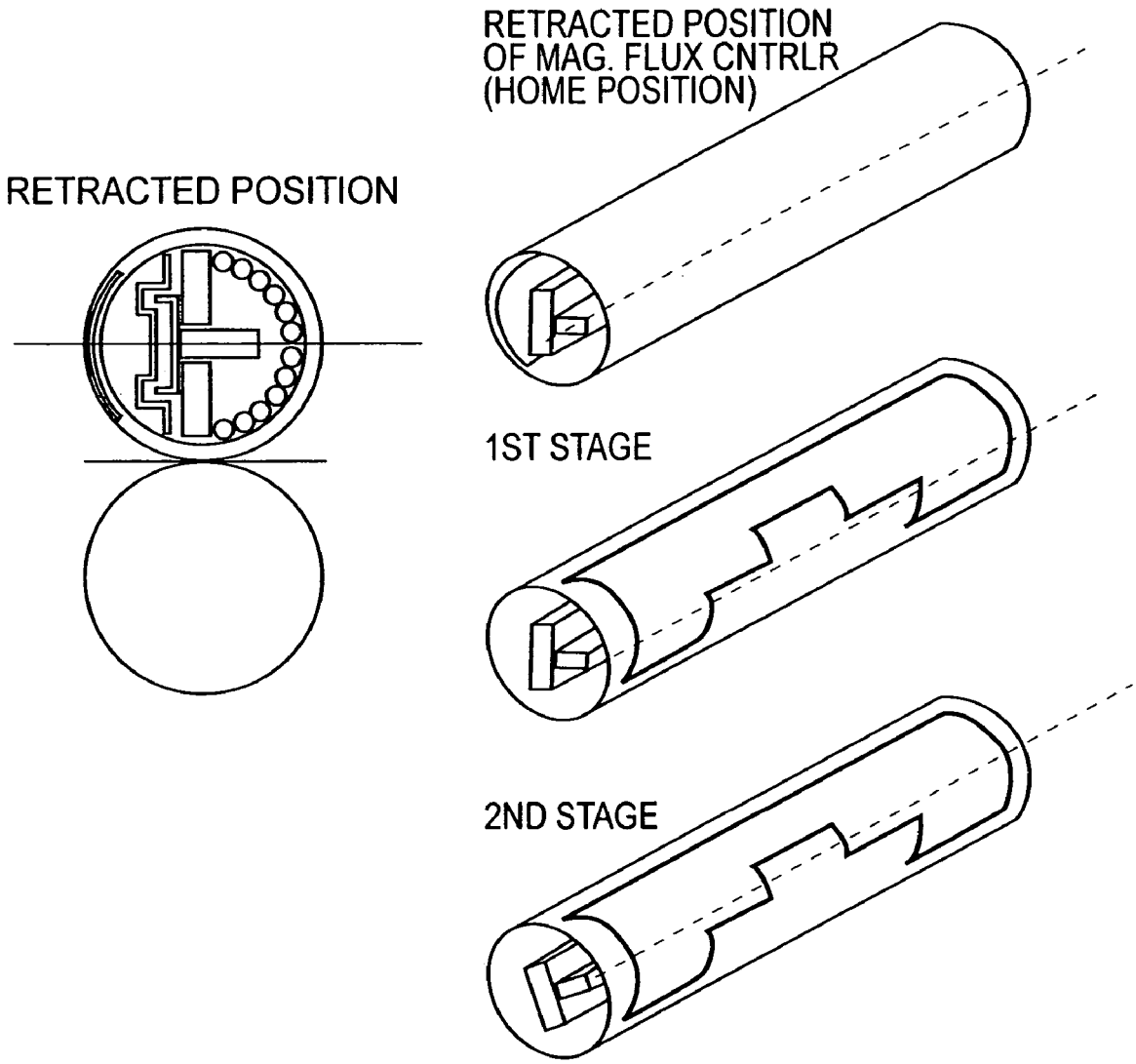
FIG. 5 is a drawing showing the retreat position in which the magnetic flux adjusting member is kept when it is not required to adjust the magnetic flux, and the relationship among the magnetic flux adjusting positions into which the magnetic flux adjusting member is movable.

FIG. 2 is a schematic vertical sectional view (parallel to lengthwise direction of apparatus) of the fixing apparatus 116, as an image heating apparatus, in this embodiment, which is a fixing apparatus (heating apparatus) of the electromagnetic induction type. This fixing apparatus 116 comprises a magnetic flux adjusting member (magnetic flux reducing member) and is capable of adjusting a magnetic flux with the use of the magnetic flux adjusting member. FIG. 3 is a diagrammatic drawing showing one of the lengthwise end portions of the magnetic flux adjusting member 18 (magnetic flux controlling member), showing the general structure thereof. FIG. 4 is a cross-sectional view (perpendicular to lengthwise direction of apparatus) of the fixing apparatus 116 in this embodiment, and FIG. 5 is a perspective view (along with cross-sectional view) of the magnetic flux adjusting member in this embodiment, showing its magnetic flux blocking positions, that is, the magnetic flux adjusting positions, and its retreat position into which it is retracted from the magnetic flux blocking positions.

Designated by a referential symbol 7 is a cylindrical fixation roller as the member in the wall of which heat is generated by electromagnetic induction (which hereinafter may be referred to simply as electromagnetically heatable member). The fixation roller 7 is rotatably supported by and between the side plate 12*a* and 12*b* of the main assembly of the image heating apparatus, with a pair of bearings 11*a* and 11*b* placed between the side plate 12*a* and 12*b* and the lengthwise end portions of the fixation roller 7, one for one. As the material for the fixation roller 7, it is desired to use a metallic substance such as iron, nickel, cobalt, or the like. The usage of a ferromagnetic metal (metal greater in permeability) as the material for the fixation roller 7 makes it possible to confine a greater portion of the magnetic flux generated by a magnetic flux generating means, in the wall of the fixation roller 7; that is, it makes it possible to increase the wall of the fixation roller 7 in magnetic flux density. Therefore, it can induce eddy current in the surface portion of the fixation roller 7 at a higher level of efficiency, and therefore, can heat the fixation roller 7 at a higher level of efficiency. The thickness of the wall of the fixation roller 7 is made to be in a range of roughly 0.3–2 mm in order to render the fixation roller 7 relative low in thermal capacity. The surface layer of the fixation roller 7 is an unshown toner releasing layer, which normally is a 10–50 μm thick layer formed of PTFE or a 10–50 μm thick layer formed of PFA. The fixation roller 7 may be provided with a rubber layer, which is placed on the immediate inward side of the toner releasing layer. Designated by a referential symbol 1 is a heating assembly disposed within the hollow of the fixation roller 7. The heating assembly 1 is made up of a coil, a core, a holder as a supporting member, etc. The structure of this heating assembly 1 will be described in detail in the following Section (3).

Designated by a referential symbol 8 is an elastic pressure roller disposed under the fixation roller 7, in parallel to the fixation roller 7. The elastic pressure roller 8 is rotatably supported between a pair of pressure roller bearings 15*a* and 15*b*. It is kept pressed upon the downwardly facing portion of the peripheral surface of the fixation roller 7 with the application of a predetermined amount of pressure provided by a unshown pressure applying means, against the elasticity of the pressure roller 8, forming thereby a fixation nip N as a heating portion with a predetermined width. The pressure roller 8 is made up of a metallic core formed of iron, a silicone rubber layer coated on the peripheral surface of the metallic core, and a toner releasing layer, similar to that of the fixation roller 7, coated on the peripheral surface of the silicone rubber layer. The fixation roller 7 is provided with a pair of fixation roller gears 10*a* and 10*b*, which are attached to the lengthwise end portions of the fixation roller 7, one for one. As rotational force is transmitted to the fixation roller gear 10*a* from an unshown driving system, the fixation roller 7 is rotationally driven at a predetermined peripheral velocity in the clockwise direction indicated by an arrow mark A in FIG. 4. The pressure roller 8 is rotated by the rotation of the fixation roller 7 in the counterclockwise direction indicated by an arrow mark B.

To the excitation coil 5 of the heating assembly 1 disposed within the hollow of the fixation roller 7, electric power (high frequency electric current) is supplied from an electric power controlling apparatus 13 (excitation circuit) through a pair of power lines 9 for supplying the coil with electric power. As a result, a magnetic flux (alternating magnetic field) is generated by the heating assembly 1, and this magnetic flux induces eddy current in the wall of the fixation roller 7 as a member in which heat is generated. The eddy current induced in the wall of the fixation roller 7 generates heat in the wall of the fixation roller 7 (Joule heat: heat resulting from current loss); in other words, the fixation roller 7 is heated. The temperature of the fixation roller 7 is detected by a first temperature detecting means 16 (thermistor or the like), and the signal representing the detected temperature level of the fixation roller 7 is inputted into a control circuit 17, which controls the fixation roller temperature by controlling the electric power supplied to the excitation coil 5 of the heating assembly 1 from the electric power controlling apparatus 13, so that the detected temperature level of the fixation roller 7 inputted from the first temperature detecting means 16 remains at a predetermined level for image fixation.

As described above, while the fixation roller 7 and pressure roller 8 are rotationally driven, the temperature of the fixation roller 7 is kept at a predetermined level for image fixation by the heat generated by the eddy current induced in the wall of the fixation roller 7 by the magnetic flux generated by the excitation coil 5 of the heating assembly 1, as the electric power is applied to the excitation coil 5. Referring to FIG. 4, while the temperature of the fixation roller 7 is kept at the predetermined image fixation level, a recording medium S, bearing an unfixed toner image having just been electrostatically transferred onto the recording medium S in the abovementioned transfer portion of the image forming apparatus, is introduced into the fixation nip N of the fixing apparatus 116 from the direction indicated by an arrow mark C as it is conveyed through the recording medium conveyance passage H. Then, the recording medium S is conveyed through the fixation nip N while remaining pinched between the fixation roller 7 and pressure roller 8. While the recording medium S is conveyed through the fixation nip N, remaining pinched by the two rollers 7 and 8, the unfixed toner image on the recording medium S is fixed as a permanent image to the surface of the recording medium S by the heat from the fixation roller 7 and the nip pressure provided by the pressure roller 8.

Designated by a referential symbol 14 is a recording medium separating claw 14, which plays the role of separating the recording medium S from the fixation roller 7, preventing thereby the recording medium S from wrapping around the fixation roller 7, after being introduced into the fixation nip N and conveyed out of the fixation nip N.

As for the positional relationship between a recording medium S and the fixing apparatus in this embodiment, in terms of the direction perpendicular to the recording medium conveyance direction, while the recording medium S is conveyed through the fixing apparatus 116, the recording medium S is conveyed so that the center of the recording medium S coincides with the center of the fixing apparatus 116. Referring to FIG. 2, designated by a referential symbol W1 is the width of the path the widest recording medium S, in terms of the direction perpendicular to the recording medium conveyance direction, conveyable through the fixing apparatus 116, and designated by a referential symbol W2 is the width of the path of a recording medium S which is narrower in width than the widest recording medium S. Designated by a referential symbol W3 is the portion of the fixation nip N, which will be outside the recording medium path when a recording medium of the smaller size is conveyed through the fixing apparatus 116. In other words, the portion W3 is the portion of the fixation nip N, which is between the edge of the path of the widest recording medium S and the corresponding edge of the path of the narrower recording medium S (portions of recording medium paths designated by referential symbols W1, W2, and W3 in FIG. 2 are only one halves of the actual recording medium paths, one for one).

A recording medium with the largest width W1 conveyable through the fixing apparatus 116 in this embodiment is a recording medium of a size A4 (297 mm in width), and a recording medium of a size A4R (210 mm in width) is used as an example of a recording medium with a width less than that (width W1) of the widest recording medium. Hereinafter, a recording medium with the largest width W1 conveyable through the fixing apparatus in this embodiment will be referred to as recording medium of the normal size, and the width W1 will be referred to as normal width.

(3) Heating Assembly 1

Designated by a referential symbol 1 is a heating assembly as a magnetic flux generating means, which is disposed in (inserted into) the hollow of the cylindrical fixation roller 7. The heating assembly 1 is made up of a holder 2, the excitation coil 5, magnetic core 6 (a, b), a stay, etc. The excitation coil 5 and magnetic core 6 make up the actual magnetic flux generating portion of the heating assembly 1. The stay is for supporting the excitation coil 5 and magnetic core 6. The heating assembly 1 is also provided with a magnetic flux adjusting member 18 (magnetic flux blocking member (magnetic flux reducing member), shutter), which is rotatably disposed on the outward side of the holder 2, in terms of the radius direction of the fixation roller 7, so that its rotational axis coincides with the axial line of the holder 2. The holder 2 is in the form of a trough, which is roughly semicircular in cross section. The magnetic core 6 (which is made up of first portion 6*a* and second portions 6*b*, and hereinafter, will be referred to simply as core), which is T-shaped in cross section, is disposed in the hollow of this holder 2, in parallel to the lengthwise direction of the holder 2. The first portion 6*a* and second portions 6*b* of the magnetic core 6 are roughly the same in the dimension, in terms of the lengthwise direction of the fixation roller 7, as a recording medium of the normal width W1; they match, in width and location, the path of a recording medium of the normal size. The excitation coil 5 (which hereinafter will be referred to simply as coil) is also disposed in the hollow of the holder 2, being wound around the first portion 6*a* of the core 6. The coil 5 is roughly elliptic in contour, and its long axis is parallel to the lengthwise direction of the fixation roller 7. The overall shape of the coil 5 is such that the curvature of the contour of its outwardly facing portion matches the curvature of the internal surface of a cylindrical object such as the fixation roller 7. The coil 5 is characterized in that it is shaped so that even its lengthwise end portions, where it is bent in the shape of a letter U, are shaped so that the curvature of their contour matches that of the internal surface of the fixation roller 7. In other words, the coil 5 is disposed in the hollow of the holder 2 so that the contour of the outwardly facing portion of the coil 5 follows the internal surface of the fixation roller 7.

A holder cap 4, shown in FIG. 4, is in the form of a trough, which is roughly semicircular in cross section. It is attached to the holder 2, in the hollow of which the first portion 6*a* of the core 6 and the coil 5 are disposed, in the manner of capping the holder 2, so that the first portion 6*a* of the core 6 and the coil 5 are firmly held between the holder 2 and holder cap 4.

(4) Magnetic Flux Adjusting Apparatus

The magnetic flux adjusting apparatus of the fixing apparatus, which was mentioned regarding the example of a fixing apparatus, is provided with a magnetic flux adjusting (blocking) member 18 (magnetic flux reducing member), which is disposed in the gap between the heating assembly 1, and the fixation roller, as a member in which heat can be generated by electromagnetic induction, being enabled to be moved in the circumferential direction of the fixation roller 7 along the internal surface of the fixation roller 7. The magnetic flux adjusting apparatus is also provided with a means for moving the magnetic flux adjusting (blocking) member 18 into one of predetermined magnetic flux adjusting positions (operative positions) and a retreat position in which it does not adjust the magnetic flux. As the material for the magnetic flux reducing (blocking) member 18, a nonmagnetic and electrically conductive substance (for allowing eddy current to flow through magnetic flux adjusting member), which is low in specific resistance, is preferable; for example, copper, aluminum, silver, alloys thereof, or ferrite or the like, which is high in specific resistance, and therefore, is capable of confining a magnetic flux. Further, even a magnetic substance such as iron or nickel can be used as the material for the magnetic flux adjusting member, as long as a magnetic flux adjusting member formed thereof is provided with round through holes or through holes in the form of a slit so that the eddy current induced therein is prevented from generating heat. Referring to FIG. 2, the magnetic flux adjusting member moving means is made up of: a magnetic flux adjusting member driving gear 20 connected to the magnetic flux adjusting member 18, a gear train 24 for transmitting driving force; a motor 21 for driving the magnetic flux adjusting member; a gear position sensor 19 for detecting the position of the magnetic flux adjusting member 18; etc. The magnetic flux adjusting member driving gear 20 is provided with a slit for detecting the position of the magnetic flux adjusting member 18, which makes it possible to detect whether the magnetic flux adjusting member 18 is in the first or second position in which the magnetic flux adjusting member 18 partially blocks the magnetic flux, or in the retreat position in which the magnetic flux adjusting member does not block the magnetic flux. The magnetic flux adjusting member 18 is provided with a pair of first magnetic flux adjusting portions 8*a*, and a pair of second magnetic flux adjusting portions 8*b*, which are different in size and position. It adjusts, in size and position, in terms of the lengthwise direction of the fixation roller 7, the range in which the magnetic flux is allowed to act on the fixation roller 7, by being moved into one of the two magnetic flux adjusting positions in which the first or second magnetic flux adjusting portions are placed between the coil 5 and fixation roller 7.

(Shape of Magnetic Flux Adjusting Member)

FIG. 3 shows the relationship among the shape of the magnetic flux adjusting member, sizes of the recording mediums conveyable through the fixing apparatus, and position of the thermistors. The edge of the magnetic flux adjusting member, on the magnetic flux adjusting side, has steps. To describe more concretely, the magnetic flux adjusting member 18 is provided with the pair of first magnetic flux adjusting portions 18*a* for blocking the portions of the magnetic flux, which correspond in position to the first portions of the fixation nip N, in terms of the lengthwise direction of the fixation roller 7, and the pair of second magnetic flux adjusting portions 18*b* for blocking the second portions of the magnetic flux, which correspond in position to the second portions of the fixation nip N, in terms of the lengthwise direction f the fixation roller 7. The second portions of the fixation nip N includes the first portions of the fixation nip N, one for one, being therefore greater in size than the first portions. More specifically, referring to FIG. 8, each of the second magnetic flux adjusting portions 18*b* extends outward from a point which is 80 mm outward from the centerline of a recording medium being conveyed (center of fixation roller), and the corresponding first magnetic flux adjusting portion 18*a* extends outward from a point which is 125 mm outward from the centerline of a recording medium being conveyed (center of fixation roller), creating thereby a step at each of the inward edges of the second and first magnetic flux adjusting portions 18*b* and 18*a*. In this embodiment, the dimensions of the first and second magnetic flux adjusting portions 18*a* and 18*b* have been set to values which best match the sizes of the recording mediums which are expected to be highest in the frequency with which they are conveyed through the fixing apparatus. Thus, the size of a recording medium capable of being conveyed through the portions of the fixation nip N between the pair of second magnetic flux adjusting portions 18*b*, without infringing into the portions of the fixation nip N between the pair of second magnetic flux adjusting portions, when the second magnetic flux adjusting portions 18*b* are in the magnetic flux adjusting positions will be hereinafter referred to as small size, and the size of a recording medium capable of being conveyed through the portions of the fixation nip N between the pair of first magnetic flux adjusting portions 18*a*, without infringing into the portions of the fixation nip N between the pair of first magnetic flux adjusting portions 18*a*, when the first magnetic flux adjusting portions 18*a* are in the magnetic flux adjusting positions will be referred to as medium size, provided that the size is not the small size. The size which is not the small or medium size is referred to as large size.

The first magnetic flux adjusting portion essentially bears the role of blocking the portion of the magnetic flux, which corresponds in size and position to the portions of the fixation roller 7 outside the path of a recording medium of the large or medium size, to prevent the temperature increase across the portions of the fixation roller 7 outside the recording medium path, whereas the second magnetic flux adjusting portion bears the role of blocking the portion of the magnetic flux, which corresponds in size and position to the portions of the fixation roller 7 outside the path of a recording medium of the medium or small size.

(Positioning of Thermistor)

The thermistors 22 and 23 (shutter thermistors) as temperature detecting means are disposed so that they correspond in position to the first and second magnetic flux adjusting portions 18*a* and 18*b*. The magnetic flux adjusting member 18 is moved into one of the magnetic flux adjustment positions, or the retreat position, so that the temperature level of the fixation roller 7 detected by the thermistors 22 or 23 remains within a predetermined range.

To describe in more detail, in terms of the lengthwise direction of the fixation nip N (fixation roller 7), the first shutter thermistor 23 (which hereinafter will be referred to simply as first thermistor) is disposed in the range in which the magnetic flux is blocked by the first magnetic flux adjusting portion, and which corresponds in size and position to the area outside the path of a recording medium of the largest size, whereas the second shutter thermistor 22 is disposed in the range in which the magnetic flux is blocked by the second magnetic flux adjusting portion, and which is not only outside the path of a recording medium of the medium size, but also, outside the range in which the magnetic flux is blocked by the first magnetic flux adjusting portion.

In a case in which the magnetic flux adjusting portions of the magnetic flux adjusting member do not perfectly match in size and position to the recording medium being conveyed, for example, when the magnetic flux adjusting member is in one of the magnetic flux adjusting positions, in which the magnetic flux adjusting portions thereof overlap with the path of the recording medium being conveyed, the portions of the fixation roller 7, which correspond to the areas in which the magnetic flux adjusting portions overlap with the recording medium path, is deprived of heat even though no heat is generated therein. Therefore, these portions of the fixation roller 7 drastically reduce in temperature, being likely to cause fixation failure.

Figure 8:
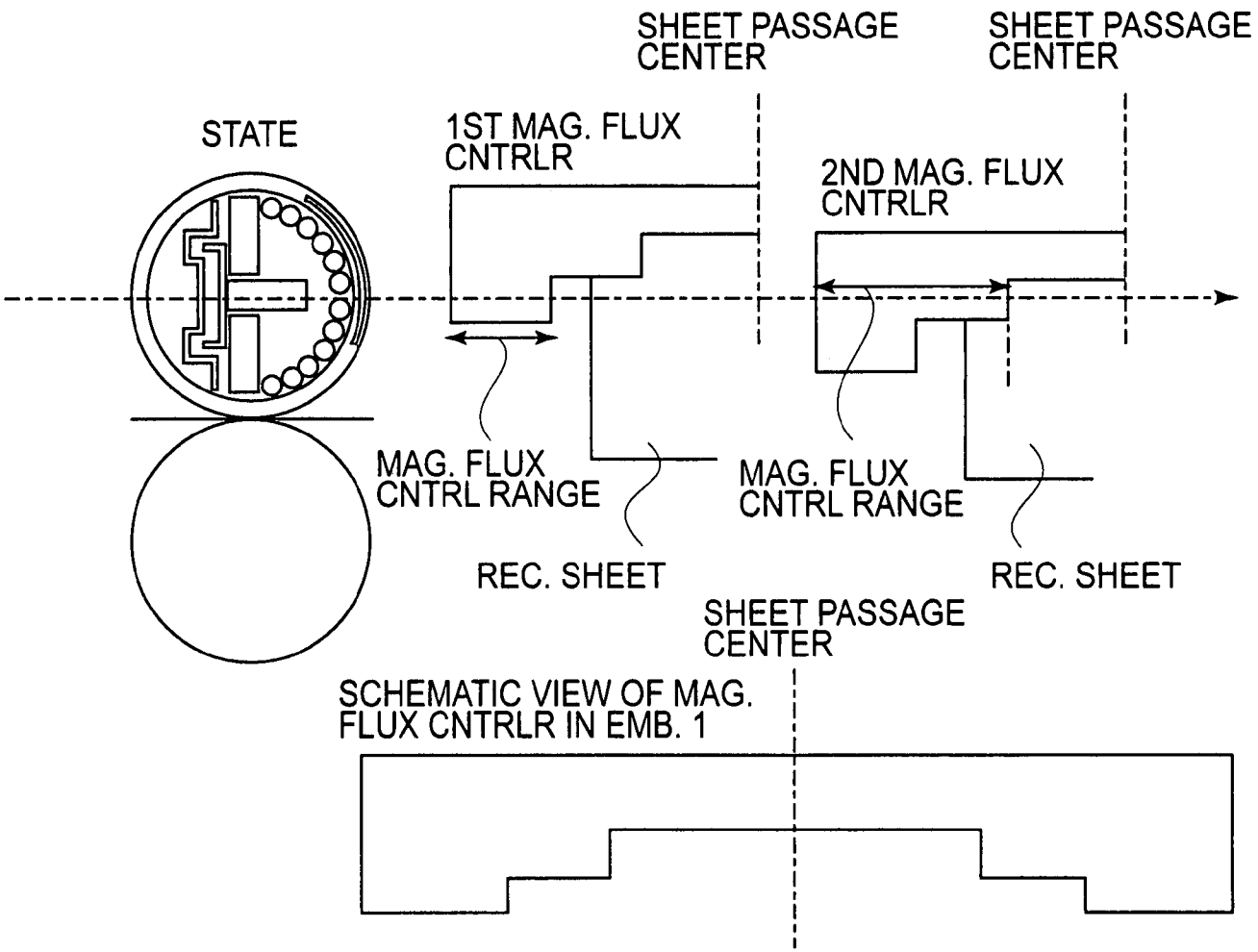
FIG. 8 is a diagrammatic drawing showing the approximate shape of the magnetic flux adjusting member, and the relationship between the excitation coil and the actual magnetic flux adjusting portions of the magnetic flux adjusting member, in the first embodiment of the present invention.

Thus, the position in which the magnetic flux adjusting member is placed to adjust the magnetic flux when the magnetic flux adjusting portions do not match in size and position to the recording medium being conveyed (when magnetic flux adjusting member is in one of magnetic flux adjusting positions, in which magnetic flux adjusting portions thereof overlap with recording medium edges) will be described. FIG. 8 shows one of the cases in which when the magnetic flux adjusting member is in one of the magnetic flux adjusting positions, the magnetic flux adjusting portions thereof do not match in size and position to a recording medium being conveyed. In this embodiment, the portions of the fixation roller 7 outside the path of a recording medium being conveyed can be prevented from increasing in temperature, by moving the magnetic flux adjusting member 18 as will be described next. That is, the magnetic flux adjusting member 18 is alternately moved into the first magnetic flux adjusting position in which the magnetic flux adjusting portions of the magnetic flux adjusting member 18 do not overlap with the edges of a recording medium being conveyed, and the second magnetic flux adjusting position in which the amount by which the magnetic flux is adjusted is one step greater than that in the first magnetic flux adjusting position (when magnetic flux adjusting member in second position, magnetic flux adjusting portions thereof do not overlap with edges of recording medium being conveyed). With the employment of this procedure, the portions of the fixation roller 7 outside the recording medium path can be prevented from increasing in temperature, even when the magnetic flux adjusting portions do not perfectly match in size and position with a recording medium being conveyed. The details of the control of the driving of the magnetic flux adjusting member will be given along with the following description of the shutter drive control sequence.

(1) Shutter Drive Control Sequence (Medium Size)

Figure 6:
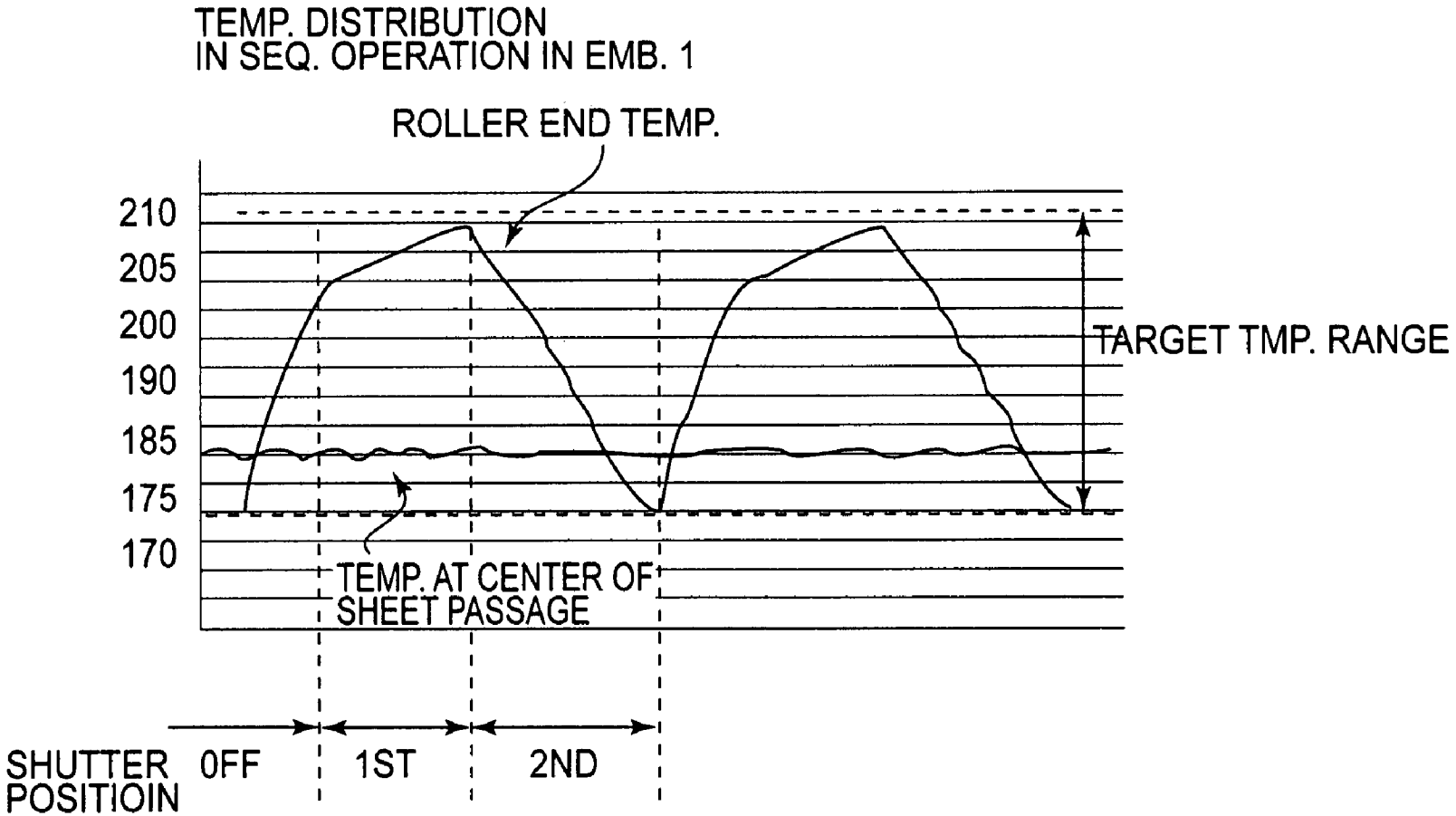
FIG. 6 is a graph showing changes in the fixation roller temperature in the first embodiment.
Figure 7:
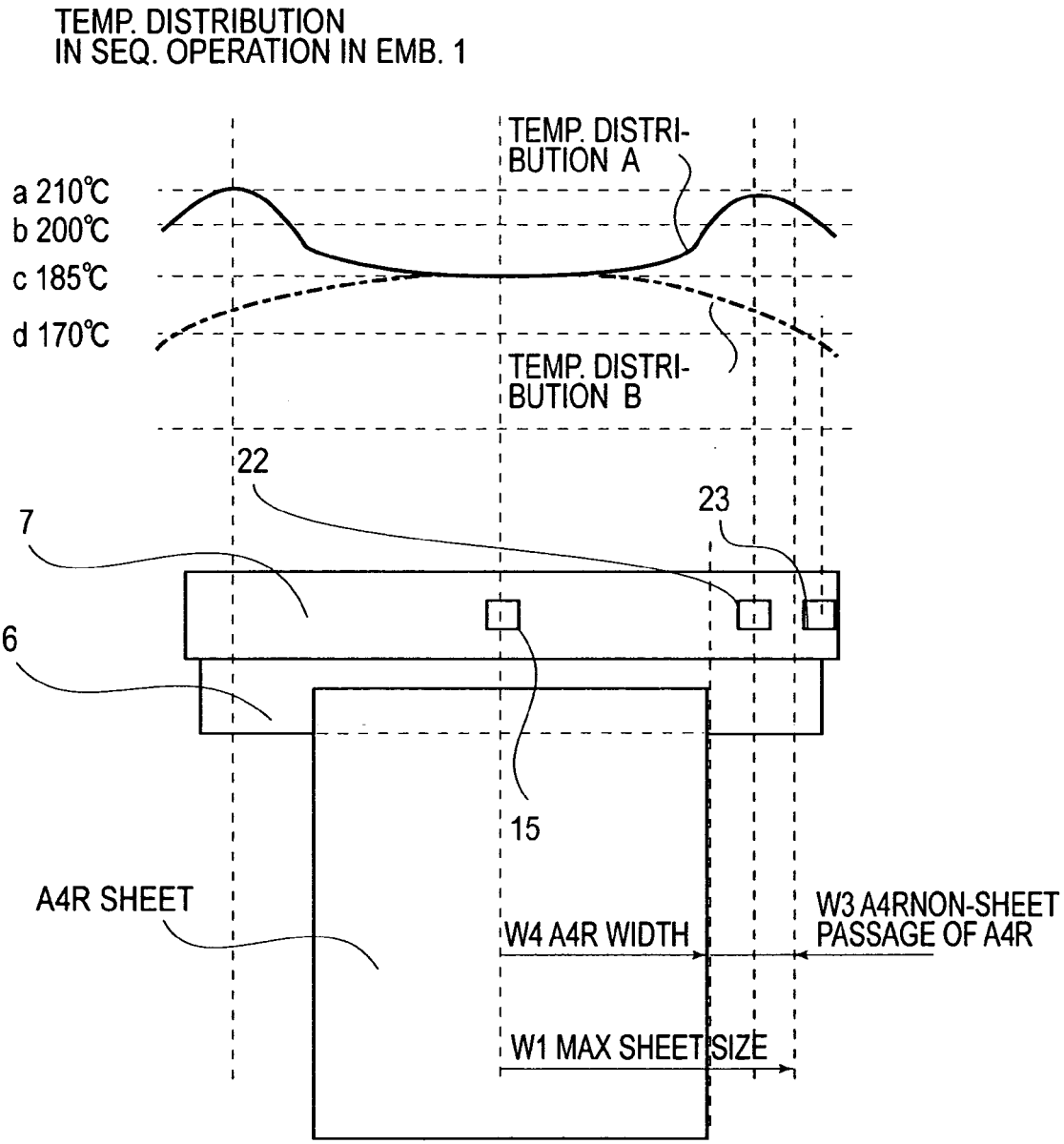
FIG. 7 is a diagrammatic drawing showing the temperature distribution of the fixation roller in the first embodiment.
Figure 9:
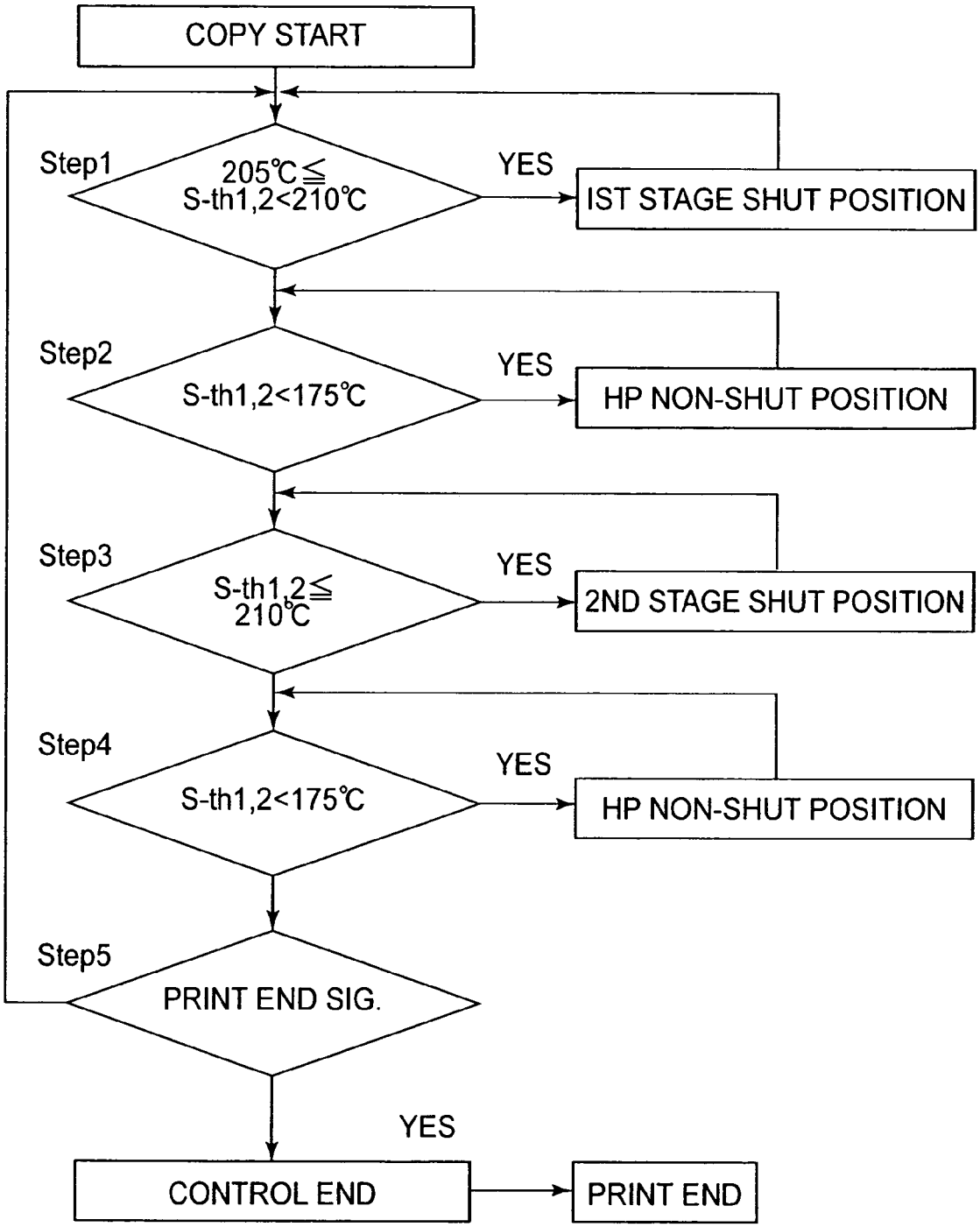
FIG. 9 is a flowchart showing how the magnetic flux adjusting means is controlled when recording mediums of a medium size are conveyed through the heating apparatus.

Next, the shutter drive control in accordance with the present invention will be described. FIG. 9 is a flowchart of the shutter drive control in accordance with the present invention. In the following description of this embodiment, the shutter driving control to be carried out when multiple recording mediums of the medium size (A4R) are continuously conveyed will be described as an example of a case in which the recording medium size does not perfectly match the size of the magnetic flux adjusting portion. FIG. 6 is a diagrammatic drawing showing the changes in the temperature levels detected by the first or second thermistor while the control sequence in accordance with the present invention is carried out. FIG. 7 is a diagrammatic drawing showing the temperature distribution of the fixation roller, in terms of the lengthwise direction thereof, which occurs when magnetic flux adjusting member 18 in this embodiment is in action.

As soon as a command for continuously producing a multiple copies of an original, using recording mediums of the medium size (hereafter, A4R), is inputted into the image forming apparatus in this embodiment, a copying operation begins. As the copying operation begins, the temperature of the lengthwise end portions of the fixation roller begins to rise (fixation roller rises in temperature so that its temperature distribution will become temperature distribution A shown in FIG. 7). During this period, the magnetic flux adjusting member 18 is kept in the predetermined retreat position.

Referring to FIG. 6, as the fixation roller continues to rise in temperature, the temperature levels detected by the first and second thermistors also rise (while shutter is kept in Off position (retreat position)).

First, a control circuit 17 (control portion) determines whether the temperature level S-th 1 detected by the first thermistor, or the temperature level S-th 2 detected by the second thermistor, has reached a level in a range of 205° C.–210° C. As soon as the temperature level S-th 1 detected by the first thermistor, or the temperature level S-th 2 detected by the second thermistor, reaches 205° C., the control portion 17 moves the magnetic flux adjusting (blocking) member 18 into the first magnetic flux blocking position (FIG. 8, and Step 1 in FIG. 9), reducing (blocking) thereby the portions of the magnetic flux, which correspond in position to the portion W3 of the fixation nip N, that is, the out-of-path portion, which is between the edge of the path of the widest recording medium and the corresponding edge of the path of the narrower recording medium. Then, if the temperature level S-th 1 detected by the first thermistor, or the temperature level S-th 2 detected by the second thermistor, is no more than 205° C., the control 17 determines whether the temperature level S-th 1 detected by the first thermistor, or the temperature level S-th 2 detected by the second thermistor, is more than 175° C. When the temperature level S-th 1 detected by the first thermistor, or the temperature level S-th 2 detected by the second thermistor, is no more than 175° C., the control portion 17 moves the magnetic flux adjusting member 18 into the predetermined retreat position (home position) as shown in FIG. 5.

Normally, as multiple recording mediums of the medium size are continuously conveyed through the fixing apparatus, the portions of the fixation roller, which correspond in position to the out-of-path areas W3, that is, the areas in which the magnetic flux is blocked, continues to gradually rise in temperature as do the lengthwise end portions of the fixation roller as shown in FIG. 6. Thus, the temperature level S-th 1 detected by the first thermistor, or the temperature level S-th 2 detected by the second thermistor, becomes higher than 175° C., in Step 2, and therefore, the control portion 17 advances to Step 3, in which the control portion 17 determines whether or not the temperature level S-th 1 detected by the first thermistor, or the temperature level S-th 2 detected by the second thermistor, is no less than 210° C. As soon as the temperature level S-th 1 detected by the first thermistor, or the temperature level S-th 2 detected by the second thermistor, reaches 210° C., the control portion 17 moves the magnetic flux adjusting member 18 into the second magnetic flux adjusting position (FIGS. 8 and 5, and Step 3 in FIG. 9), blocking thereby the portions of the magnetic flux, which correspond in position to the out-of-path areas W3. If it is not so in Step 4, the control portion 17 advances to Step 5, in which it determines whether or not the temperature level S-th 1 detected by the first thermistor, or the temperature level S-th 2 detected by the second thermistor, is no more than 175° C. When the temperature level S-th 1 detected by the first thermistor, or the temperature level S-th 2 detected by the second thermistor, is no more than 175° C., the control portion 17 moves the magnetic flux adjusting member 18 into the predetermined retreat position. If it is not so, the control section 17 advances to Step 6, in which it determines whether or not the print signal indicates the end of the job. When the print signal indicates the end of the job, the control portion 17 retracts the magnetic flux adjusting member 18 into the predetermined retreat position, whereas when the print signal does not indicate the end of the job, the control portion 17 returns to Step 1, and begins repeating the above described control sequence. In other words, until the current copying job ends, the control portion 17 repeats the above described control sequence, preventing thereby the portions of the fixation roller, which correspond to the out-of-path areas of the fixation nip N, from rising in temperature to a level at which they will be thermally damaged, and also, it moves the magnetic flux adjusting member into the retreat position (FIG. 5), that is, the position in which the magnetic flux adjusting member does not block the magnetic flux, as the decrease in the surface temperature of the fixation roller is detected.

As described above, by adjusting in two stages the portions of the magnetic flux, which correspond in position to the out-of-path areas of the fixation nip, the temperature level of the fixation roller outside the path of the recording medium being conveyed can be kept within the predetermined range, even when multiple recording mediums, which do not match in size to any of the magnetic flux adjusting portions of the magnetic flux adjusting member, are continuously conveyed through the fixing apparatus.

Further, by providing the fixing apparatus with two or more temperature detecting means, it is possible to detect, as closely as possible, the peaks of the temperature distribution of the fixation roller, across the portions of the fixation roller outside the recording medium path, the size of which are changed by the size of a recording medium being conveyed. Therefore, the surface temperature of the fixation roller can be kept within the predetermined range.

In this embodiment, the temperature of the portions of the fixation roller outside the recording medium path is detected, and the shutter is moved in response to the detected temperature. However, this setup in this embodiment is not intended to limit the scope of the present invention. For example, the shutter may be controlled in multiple stages according to the size of a recording medium being conveyed, the number of the recording mediums being conveyed per unit of time, or length of time multiple recording mediums are being conveyed.

This embodiment was described with reference to the image forming operation in which multiple recording mediums of the medium size were continuously conveyed through the fixing apparatus. However, the effectiveness of the present invention is not affected even if an image forming operation carried out by an image forming apparatus employing a fixing apparatus in accordance with the present is such that a set of originals different in size are continuously copied, and therefore, multiple recording mediums different in size are continuously conveyed in a specific or random order through the fixing apparatus. Obviously, the effectiveness of the present invention is not affected by the size of a recording medium to be used for image formation, that is, whether recording mediums to be used for image formation is of the large or small size.

That is, the magnetic flux adjusting member has only to be controlled as follows: As the temperature of the portions of the fixation roller outside the recording medium path reaches a predetermined level, the magnetic flux adjusting member is moved so that the range, in terms of the lengthwise direction of the fixation roller (fixation nip), in which the magnetic flux is adjusted (blocked) by the magnetic flux adjusting portions of the magnetic flux adjusting member, increases one step (one size), or in steps. Then, as the temperature of the portions of the fixation roller outside the recording medium path falls below the predetermined level, the magnetic flux adjusting member is moved into the predetermined retreat position.

Incidentally, the service life of the drive gears can be extended by expanding in steps the range, in terms of the lengthwise direction of the fixation roller (fixation nip), in which the magnetic flux is adjusted (blocked) by the magnetic flux adjusting member, with the selective usage of the first and second magnetic flux adjusting portion 18*a* and 18*b*, respectively, when multiple recording mediums of the small size are continuously conveyed. In other words, this control method is smaller in the number of times the magnetic flux adjusting member is driven, compared to the control method in which the magnetic flux adjusting member is directly moved from the retreat position (home position) in which it does not block the magnetic flux, to the position in which its magnetic adjusting portions 18*b* adjust (block) the magnetic flux. Further, this method makes it possible to more precisely control in temperature the portions of the fixation roller outside the recording medium path.

Further, when moving, in Step 3, the magnetic flux adjusting member, out of the second magnetic flux adjusting position to move its magnetic flux adjusting portions 18*b* out of the magnetic flux blocking positions, the magnetic flux adjusting member may be rotated a certain angle, instead of retracting it all the way into the retreat position (home position), so that the range, in which the magnetic flux is blocked by the magnetic flux adjusting member, is reduced by one size. This controlling method makes it possible to even more precisely control in temperature the portions of the fixation roller outside the recording medium path.

The usage of an image heating apparatus in accordance with the present invention is not limited to the usage as a fixing apparatus such as the one in this embodiment. For example, an image heating apparatus in accordance with the present invention can be very effectively used as such an image heating apparatus as a fixing apparatus for temporarily fixing an unfixed image to an object to be heated, or a surface property changing apparatus for changing a fixed image in surface properties such as glossiness by reheating the fixed image and the object bearing the fixed image.

Even when the magnetic flux adjusting portions of the magnetic flux adjusting member do not match in size a recording medium being conveyed, the temperature of the entirety of the heating member, in terms of its lengthwise direction, can be kept within a predetermined range, by alternately carrying out the operation for increasing, in the dimension in terms of the lengthwise direction of the heating member, the range in which magnetic flux is blocked by the magnetic flux adjusting member, and the operation for decreasing the range.

While the invention has been described with reference to the structures disclosed herein, it is not confined to the details set forth, and this application is intended to cover such modifications or changes as may come within the purposes of the improvements or the scope of the following claims.

This application claims Priority from Japanese Patent Application No. 307529/2004 filed Oct. 22, 2004, which is hereby incorporated by reference.

What is claimed is:

1. A image heating apparatus comprising:

a coil for generating magnetic flux;

a rotatable heat generation member having a heat generation portion, which generates heat by magnetic flux, for heating a image on a recording material;

magnetic flux shield means having a plurality of regions capable of shielding the magnetic flux which is directed toward said heat generation member from said coil at an end portion of said heat generation member with respect to a rotational axis direction of said heat generation member;

moving means for moving said magnetic flux shield means; and control means for controlling, during a series of continuous image heating operations, movement of said moving means from a first position for shielding the magnetic flux at the end portion to a second position for reducing a width of magnetic flux shielding.

2. An apparatus according to claim 1, wherein said moving means is capable of moving said magnetic flux shield means to a retracted position retracted from the position for shielding the magnetic flux at the end portion.

3. An apparatus according to claim 1, wherein said control means controls the movement of said magnetic flux shield means from the second position to the first position.

4. An apparatus according to claim 1, wherein said magnetic flux shield means is movable between a first magnetic flux shield portion and a second magnetic flux shield portion, wherein said first magnetic flux shield portion and said second magnetic flux shield portion are arranged along the rotational axis direction and have different widths which are different from that at the end portion, and wherein said moving means changes the position of said magnetic flux shield portion opposing a reference position of said heat generation member.

5. An apparatus according to claim 1, further comprising a first temperature detecting member for detecting a temperature of a neighborhood of a central portion of said heat generation member, electric power supply control means for controlling electric power supply to said coil on the basis of an output of said first temperature detecting member, and second temperature detecting member for detecting a temperature of a region in which the magnetic flux is shielded when said magnetic flux shield means is at the first position, wherein said control means effects the control operation on the basis of an output of said second temperature detecting means.

6. An apparatus according to claim 1, wherein magnetic flux said shield means includes a single metal plate having a plurality of magnetic flux shield portions which are remote from the end portion by different distances, and said moving means changes a position of said magnetic flux shield portion opposing a reference position of said heat generation member.

* * * * *

UNITED STATES PATENT AND TRADEMARK OFFICE

CERTIFICATE OF CORRECTION

PATENT NO. : 7,238,924 B2
APPLICATION NO. : 11/254705
DATED : July 3, 2007
INVENTOR(S) : Toshiharu Kondo et al.

It is certified that error appears in the above-identified patent and that said Letters Patent is hereby corrected as shown below:

COLUMN 1
Line 32, “heat” should read --heated--.
Line 61, “Fourier s” should read --Fourier’s--.
Line 64, “above described” should read --above-described--, and “causes” should read --cause--.
Line 66, “apparatus,” should read --apparatus.--.
Line 67, “that is,” should read --That is,--.

COLUMN 2
Line 10, “width, in” should read --width in--.
Line 20, “damaged, by” should read --damaged by--.
Line 29, “fixed, by” should read --fixed by--.
Line 43, “above described” should read --above-described--.

COLUMN 3
Line 31, “direction its” should read --direction of its--.
Line 43, “above” should read --above- --.
Line 62, “size, from” should read --size from--.

COLUMN 4
Line 9, “increases” should read --increase--.
Line 15, “above described” should read --above-described--.

COLUMN 5
Line 1, “above described” should read --above-described--.
Line 22, “above described” should read --above-described--.
Line 46, “position, during” should read --position during--.

COLUMN 6
Line 34, “stepwisely” should read --stepwise--.

COLUMN 7
Line 41, “as photosensitive drum” should read --as the photosensitive drum--.

COLUMN 8
Line 40, “are removed” should read --is removed--.

UNITED STATES PATENT AND TRADEMARK OFFICE

CERTIFICATE OF CORRECTION

PATENT NO. : 7,238,924 B2
APPLICATION NO. : 11/254705
DATED : July 3, 2007
INVENTOR(S) : Toshiharu Kondo et al.

It is certified that error appears in the above-identified patent and that said Letters Patent is hereby corrected as shown below:

COLUMN 9
Line 27, “apparatus, with” should read --apparatus with--.
Line 30, “As the” should read --As for the--.
Line 43, “relative” should read --relatively--.

COLUMN 10
Line 31, “apparatus 13, so” should read --apparatus 13 so--.
Line 40, “assembly 1,” should read --assembly 1--.

COLUMN 11
Line 6, “path the” should read --path of the-- and “medium S,” should read --medium S.--.
Line 7, “in terms” should read --In terms--.
Line 9, “116, and” should read --116 and--.

COLUMN 13
Line 21, “f The” should read --of the--.
Line 22, “includes” should read --include--.

COLUMN 14
Line 28, “positions, in” should read --positions in--.
Line 33, “is deprived” should read --are deprived--.
Line 51, “temperature, by” should read --temperature by--.
Line 60, “when magnetic flux adjusting member in” should read --when the magnetic flux of the adjusting member is in--.
Line 61, “second” should read --the second--.

COLUMN 15
Line 22, “producing a” should read --producing--.

COLUMN 16
Line 34, “above” should read --above- --.
Line 36, “above” should read --above- --.
Line 40, “damaged, and also” should read --damaged. Also,--.
Line 43, “flux, as” should read --flux as--.

UNITED STATES PATENT AND TRADEMARK OFFICE

CERTIFICATE OF CORRECTION

PATENT NO. : 7,238,924 B2
APPLICATION NO. : 11/254705
DATED : July 3, 2007
INVENTOR(S) : Toshiharu Kondo et al.

It is certified that error appears in the above-identified patent and that said Letters Patent is hereby corrected as shown below:

COLUMN 17
Line 20, “is of” should read --are of--.
Line 56, “rotated a” should read --rotated at a--.

COLUMN 18
Line 26, “A image” should read --an image--.
Line 30, “a image” should read --an image--.

COLUMN 19
Line 6, “wherein magnetic” should read --wherein said magnetic--.
Line 7, “said” should be deleted.

Signed and Sealed this

Twentieth Day of May, 2008

JON W. DUDAS
*Director of the United States Patent and Trademark Office*